US007898491B1

(12) United States Patent
Curran et al.

(10) Patent No.: US 7,898,491 B1
(45) Date of Patent: Mar. 1, 2011

(54) REFLECTOR ANTENNA FEED RF SEAL

(75) Inventors: John Curran, Kircaldy (GB); Roy Campbell, Ladybank (GB)

(73) Assignee: Andrew LLC, Hickory, NC (US)

( * ) Notice: Subject to any disclaimer, the term of this patent is extended or adjusted under 35 U.S.C. 154(b) by 0 days.

(21) Appl. No.: 12/865,654

(22) PCT Filed: Nov. 5, 2009

(86) PCT No.: PCT/IB2009/054921

§ 371 (c)(1),
(2), (4) Date: Jul. 30, 2010

(51) Int. Cl.
*H01Q 19/19* (2006.01)

(52) U.S. Cl. ..... 343/781 P; 343/781 R; 343/781 CA; 343/912

(58) Field of Classification Search ..... 343/781 R, 343/781 P, 781 CA, 834, 912, 915
See application file for complete search history.

(56) References Cited

U.S. PATENT DOCUMENTS

| | | | | |
|---|---|---|---|---|
| 2,694,778 | A * | 11/1954 | Rowland et al. | 343/781 R |
| 2,945,229 | A * | 7/1960 | Klauser | 343/754 |
| 4,689,637 | A * | 8/1987 | Ochiai et al. | 343/914 |
| 4,876,554 | A * | 10/1989 | Tubbs | 343/780 |
| 5,714,963 | A * | 2/1998 | Cox | 343/786 |
| 5,870,062 | A | 2/1999 | Cox | |
| 6,137,449 | A | 10/2000 | Kildal | |
| 6,429,826 | B2 | 8/2002 | Karlsson et al. | |
| 6,522,305 | B2 | 2/2003 | Sharman | |
| 6,985,120 | B2 * | 1/2006 | Lewry et al. | 343/781 CA |
| 2005/0017916 | A1 | 1/2005 | Lewry et al. | |
| 2009/0207095 | A1 | 8/2009 | Kimura et al. | |

FOREIGN PATENT DOCUMENTS

| | | |
|---|---|---|
| EP | 0136817 | 4/1985 |
| EP | 0817307 | 1/1998 |
| EP | 0859427 | 8/1998 |

OTHER PUBLICATIONS

International Search Report / KR, related application PCT/IB2009/054921, application date Nov. 5, 2009 by Korean Intellectual Property Office, Republic of Korea.

* cited by examiner

*Primary Examiner*—Tho G Phan
(74) *Attorney, Agent, or Firm*—Babcock IP, PLLC

(57) ABSTRACT

A reflector antenna feed RF seal between an antenna base, a feed hub and a vertex plate. The RF seal formed via a generally annular gasket of compressible material adapted to seat around an outer diameter of the feed hub. The gasket having an outer diameter greater than a diameter of a joint between the feed hub and the antenna base and less than an outer diameter of the vertex plate. The gasket compressed within a cavity formed between the antenna base, the feed hub and the vertex plate as the feed hub is seated within the antenna base.

20 Claims, 5 Drawing Sheets

REFLECTOR ANTENNA FEED RF SEAL

BACKGROUND

1. Field of the Invention

This invention relates to microwave reflector antennas. More particularly, the invention relates to a Radio Frequency (RF) seal for the joint between the feed and main reflector/antenna base of a reflector antenna.

2. Description of Related Art

Self supported feed assemblies typically include a subreflector supported proximate a focal point of the main reflector by a feed waveguide coupled to a mounting hub fastened to an antenna base that also supports the main reflector. A joint between the main reflector/antenna base and the mounting hub creates an RF leakage path to the rear of the reflector antenna that generates signal backlobes known to degrade the reflector antenna signal pattern. A vertex plate is commonly applied to the proximal end of the feed waveguide and/or mounting hub to improve the overall return loss of the antenna.

Prior reflector antennas typically apply a plurality of conductive seal(s), such as a spring ring(s) and/or conductive grease, to seal the joint and/or area between the vertex plate and the main reflector/antenna base. Conductive grease application is time-consuming and may be difficult for installation personnel to correctly apply in exposed reflector antenna mounting environments, such as high atop radio towers. Also, conductive grease application may require skin protection for the installation personnel, further complicating application.

Competition in the reflector antenna market has focused attention on improving electrical performance and minimization of overall manufacturing, inventory, distribution, installation and maintenance costs. Therefore, it is an object of the invention to provide a reflector antenna feed assembly mounting hub joint seal that overcomes deficiencies in the prior art.

BRIEF DESCRIPTION OF THE DRAWINGS

The accompanying drawings, which are incorporated in and constitute a part of this specification, illustrate embodiments of the invention, where like reference numbers in the drawing figures refer to the same feature or element and may not be described in detail for every drawing figure in which they appear and, together with a general description of the invention given above, and the detailed description of the embodiments given below, serve to explain the principles of the invention.

DETAILED DESCRIPTION

The inventors have developed a cavity conforming conductive and/or RF absorbent compressible gasket arrangement that eliminates the prior requirement for multiple RF seals and/or application of conductive grease, significantly reducing manufacture and assembly requirements for a reflector antenna.

Figure 1:
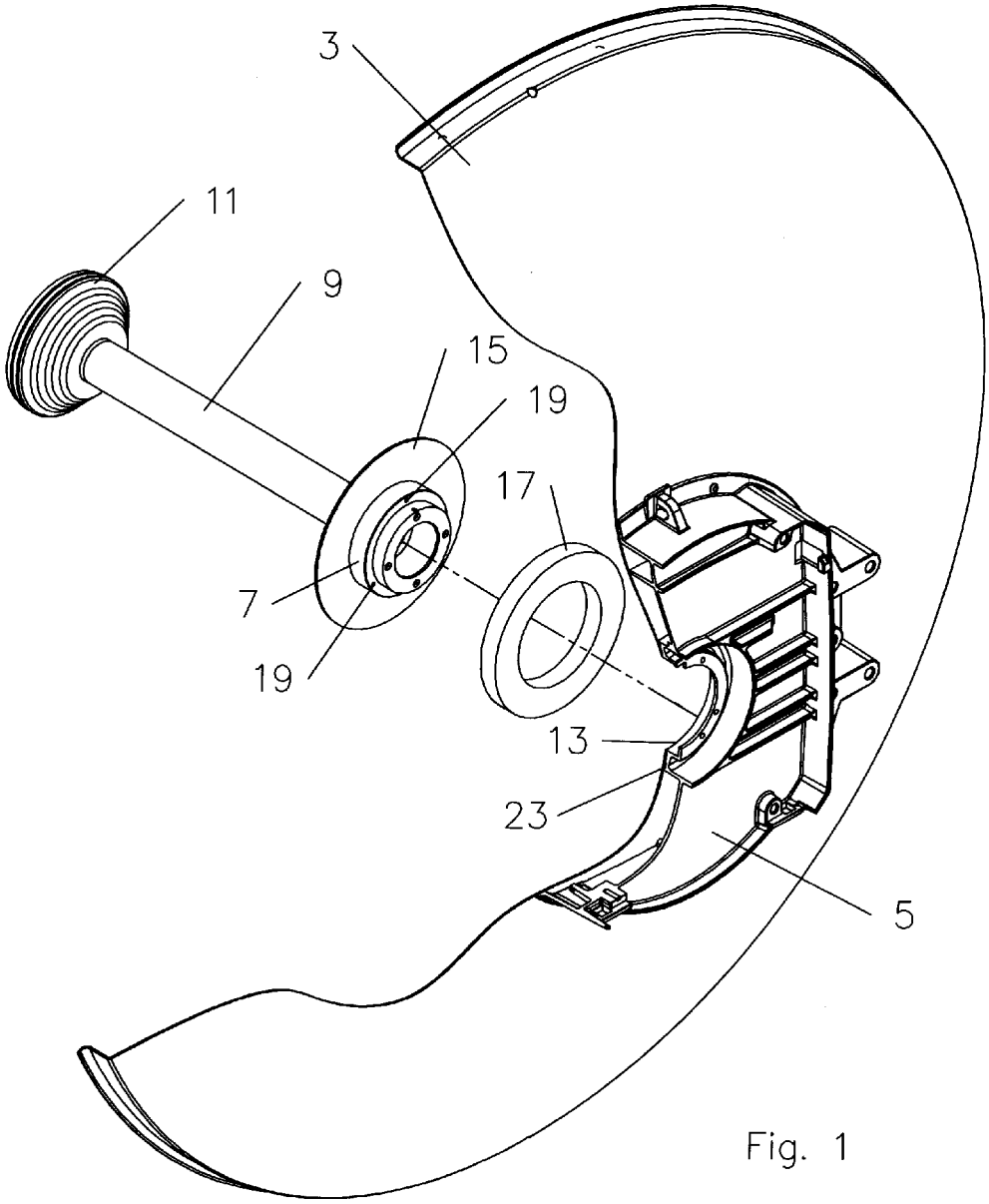
FIG. 1 is a schematic exploded isometric partial cut-away view of a reflector antenna feed hub/antenna base joint RF seal.
Figure 2:
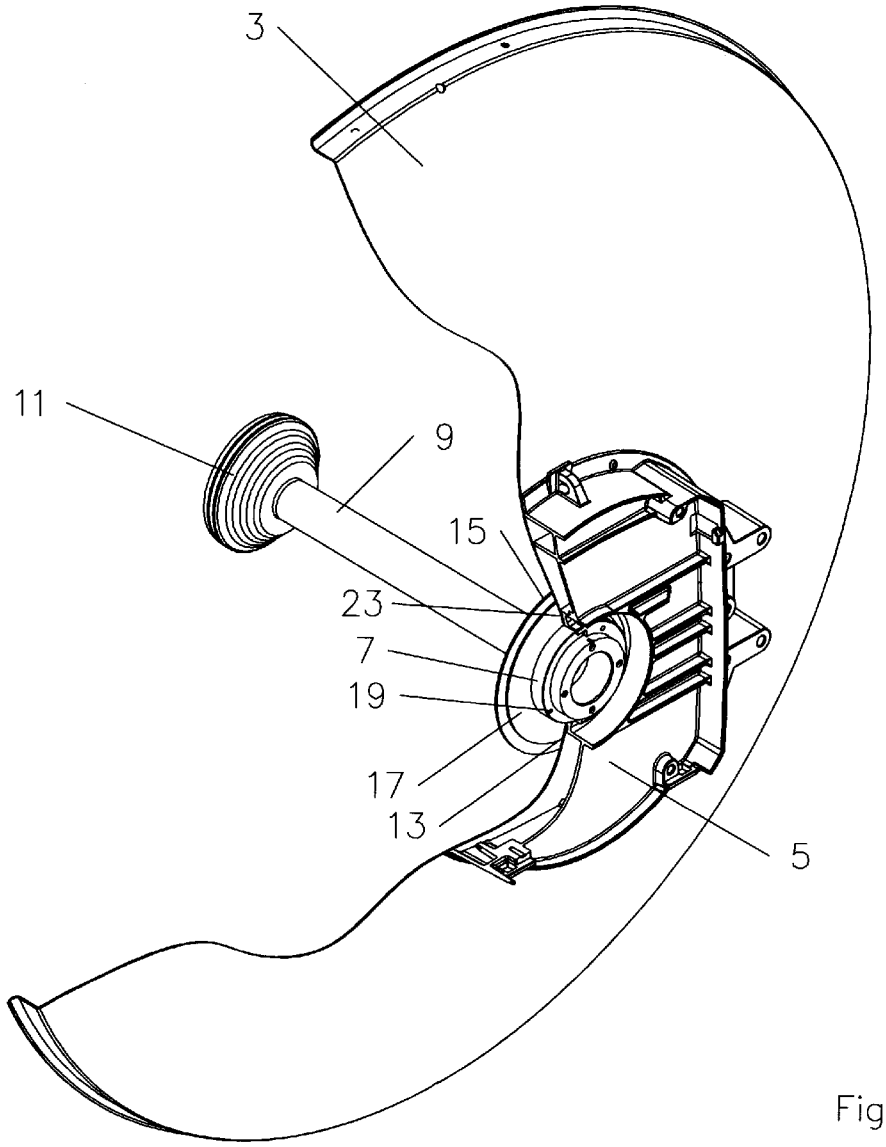
FIG. 2 is a schematic isometric partial view of FIG. 1, with the feed hub coupled to the antenna base.
Figure 3:
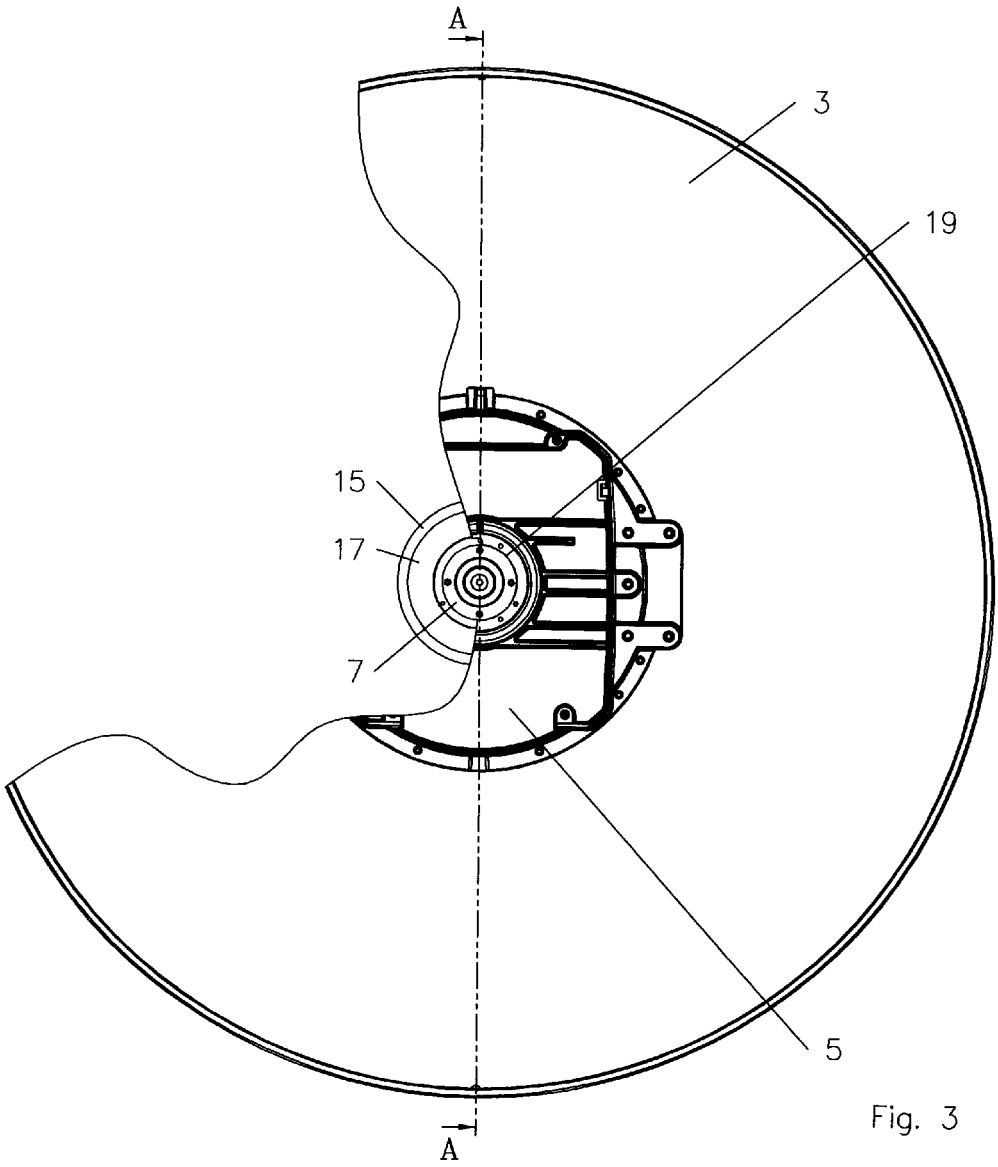
FIG. 3 is a schematic partial back view of FIG. 2.
Figure 4:
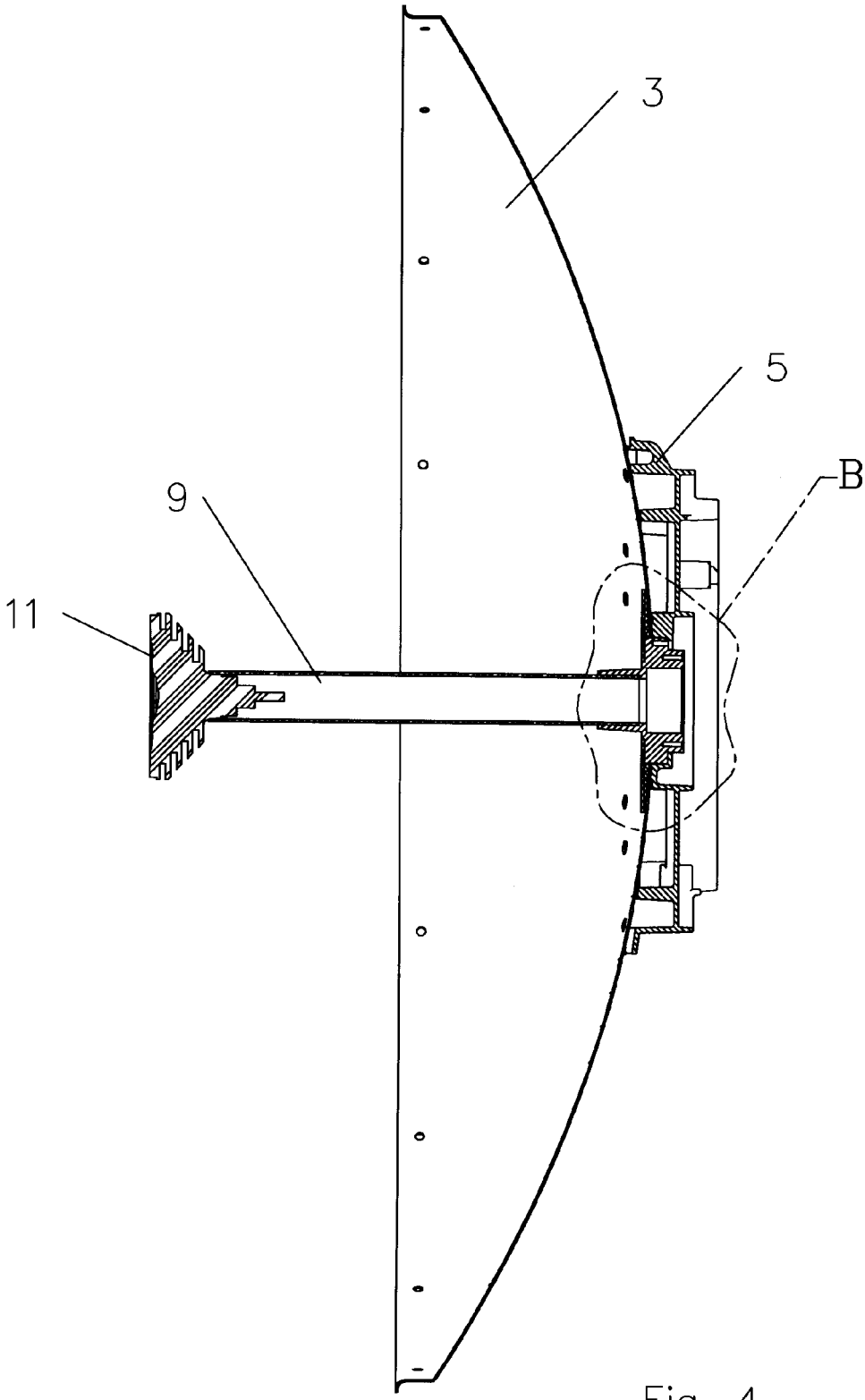
FIG. 4 is a schematic side section view of FIG. 3, along line A-A.

A first exemplary embodiment is demonstrated in FIGS. 1-5. As best shown in FIG. 1, the main reflector 3 is coupled to the antenna base 5. The antenna base 5 is adapted to receive a feed hub 7 supporting the feed waveguide 9 and subreflector 11, forming a joint 13 upon assembly. A vertex plate 15 at the proximal end of the feed waveguide 9 has a diameter greater than a periphery of the joint 13. A generally annular gasket 17 is adapted to seat between an outer surface of the feed hub 7, the vertex plate 15 and the antenna base 5.

The gasket 17 may be provided as a portion of compressible material with an outer diameter greater than at least a periphery of the mating surfaces between the feed hub 7 and the antenna base 5 and lesser than the outer diameter of the vertex plate 15. For ease of initial assembly, the gasket 17 may be dimensioned for retention in a stretch fit around the outer surface of the feed hub 7. Upon insertion of the feed hub 7 into the antenna base 5, the gasket 17 is compressed within a cavity between the vertex plate 15, feed hub 7 and antenna base 5, for example via tightening of fasteners such as screws or bolts (not shown) extending through the antenna base 5 into mounting hole(s) 19 of the feed hub 7.

The gasket 17 may be formed from a compressible conductive and/or RF absorbent material. Alternatively, the gasket 17 material may be a compressible media coated with RF absorbent material and/or conductive material. An example of a suitable compressible material coated with an RF absorbent is urethane foam with a gradient lossy coating such as C-Ram AR, by Cuming Microwave, of Avon Mass., USA. The gasket 17 may be cost effectively formed by cutting or stamping gasket(s) 17 of desired dimensions out of bulk sheets of the selected material.

Figure 5:
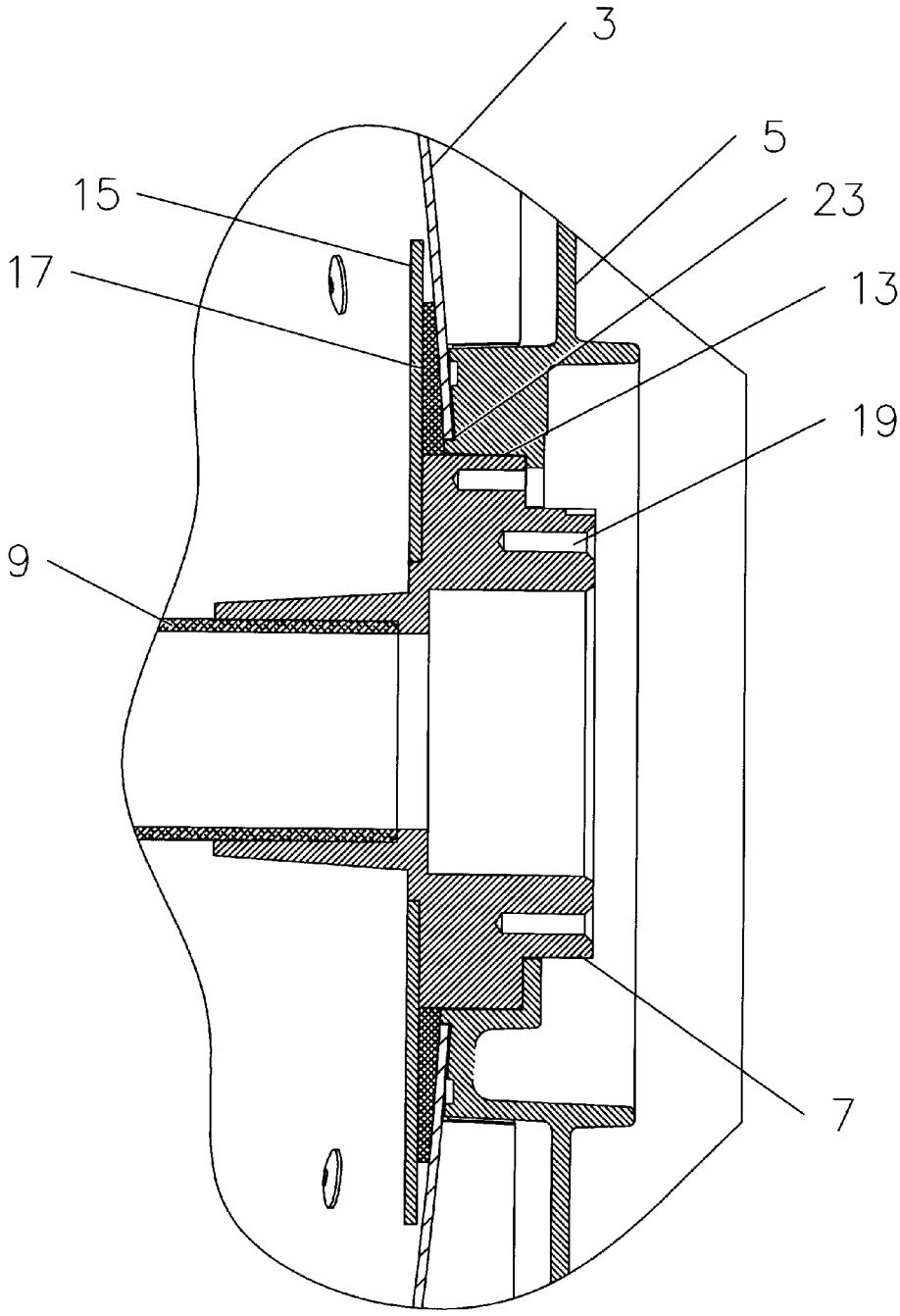
FIG. 5 is a close-up view of area B of FIG. 4.

The compression of the gasket 17 form fills the cavity between the outer diameter of the feed hub 7, the vertex plate 13 and the antenna base 5, as best shown in FIG. 5, sealing the joint 13 against RF leakage. Further, where a junction 23 between the main reflector 3 and the antenna base 5 has an outer diameter less than the outer diameter of the gasket 17, the junction 23 is also sealed by the gasket 17.

The compression of the gasket 17 may be primarily in a direction parallel to a longitudinal axis of the feed, reducing deformation of the gasket 17 in a direction normal to the longitudinal axis such that the gasket 17 does not extend beyond the diameter of the vertex plate 13 when compressed.

One skilled in the art will appreciate that, in addition to improving the electrical performance of the assembled reflector antenna, the gasket 17 arrangement also enables significant manufacturing, delivery, installation and/or maintenance efficiencies as manufacture, inventory, delivery and assembly of multiple conventional point sealing gaskets and/or conductive grease are eliminated.

Table of Parts

| | |
|---|---|
| 3 | main reflector |
| 5 | antenna base |
| 7 | feed hub |
| 9 | feed waveguide |
| 11 | subreflector |
| 13 | joint |
| 15 | vertex plate |
| 17 | gasket |
| 19 | mounting hole |
| 23 | junction |

Where in the foregoing description reference has been made to materials, ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

We claim:

1. A reflector antenna feed RF seal between an antenna base, a feed hub and a vertex plate, comprising:

a gasket of compressible material adapted to seat around an outer diameter of the feed hub;

the gasket having an outer diameter greater than a diameter of a joint between the feed hub and the antenna base and less than an outer diameter of the vertex plate;

the gasket compressed within a cavity formed between the antenna base, the feed hub and the vertex plate as the feed hub is seated within the antenna base.

2. The RF seal of claim 1, wherein the gasket is a compressible conductive material.

3. The RF seal of claim 1, wherein the gasket is a compressible RF absorbing material.

4. The RF seal of claim 1, wherein the gasket is a compressible material coated with an RF absorbing material.

5. The RF seal of claim 1, wherein the gasket is a compressible material coated with a conductive material.

6. The RF seal of claim 1, wherein the gasket is a urethane foam with a gradient lossy coating.

7. The RF seal of claim 1, wherein a junction between a main reflector and the antenna base, within the cavity, has a diameter less than the outer diameter of the gasket, whereby the gasket covers the junction.

8. The RF seal of claim 1, wherein the gasket compresses primarily in a direction parallel to a longitudinal axis of a feed coupled to the feed hub.

9. The RF seal of claim 1, wherein the gasket is annular.

10. A method for assembling a reflector antenna feed RF seal between an antenna base, a feed hub and a vertex plate, comprising the steps of:

placing a generally annular gasket of compressible material around an outer diameter of the feed hub;

inserting the feed hub into the antenna base, thereby compressing the gasket within a cavity between the antenna base, the feed hub and the vertex plate as the feed hub is inserted within the antenna base;

the gasket covering a joint between the feed hub and the antenna base.

11. The method of claim 10, wherein the gasket also covers a junction between a main reflector and the antenna base, within the cavity.

12. The method of claim 10, wherein the gasket is dimensioned to compress within the cavity, without extending beyond an outer diameter of the vertex plate.

13. The method of claim 10, wherein the gasket is urethane foam with a gradient lossy coating.

14. A reflector antenna feed RF seal between an antenna base, a feed hub and a vertex plate, comprising:

a generally annular gasket of urethane foam with a gradient lossy coating adapted to seat around an outer diameter of the feed hub;

the gasket having an outer diameter greater than a diameter of a joint between the feed hub and the antenna base and less than an outer diameter of the vertex plate;

the gasket compressed within a cavity between the antenna base, the feed hub and the vertex plate as the feed hub is seated within the antenna base;

wherein a junction between a main reflector and the antenna base, within the cavity, has a diameter less than the outer diameter of the gasket, whereby the gasket covers the joint and the junction.

15. A reflector antenna, comprising:

a feed hub joined to an antenna base along a joint;

a vertex plate coupled to the feed hub;

a gasket of compressible material adapted to seat around an outer diameter of the feed hub;

the gasket having an outer diameter greater than a diameter of the joint and less than an outer diameter of the vertex plate;

the gasket compressed within a cavity formed between the antenna base, the feed hub and the vertex plate as the feed hub is joined with the antenna base.

16. The RF seal of claim 1, wherein the gasket is a compressible RF absorbing material.

17. The RF seal of claim 1, wherein the gasket is a urethane foam with a gradient lossy coating.

18. The RF seal of claim 1, wherein a junction between a main reflector and the antenna base, within the cavity, has a diameter less than the outer diameter of the gasket, whereby the gasket covers the junction.

19. The RF seal of claim 1, wherein the gasket compresses primarily in a direction parallel to a longitudinal axis of a feed coupled to the feed hub.

20. The RF seal of claim 1, wherein the gasket is annular.

* * * * *